United States Patent [19]

Jolly

[11] Patent Number: 4,468,889

[45] Date of Patent: Sep. 4, 1984

[54] DOUBLE GLAZING ARRANGEMENT

[75] Inventor: Brian J. Jolly, Towcester, England

[73] Assignee: Polycell Products Limited, Hertfordshire, England

[21] Appl. No.: 322,701

[22] Filed: Nov. 18, 1981

[30] Foreign Application Priority Data

Nov. 24, 1980 [GB] United Kingdom ..... 8037620

[51] Int. Cl.[3] ..... E05D 13/00

[52] U.S. Cl. ..... 49/453; 49/450

[58] Field of Search ..... 49/453, 455, 454, 449, 49/450; 292/DIG. 49, DIG. 30, DIG. 53, 247, 67, 113

[56] References Cited

U.S. PATENT DOCUMENTS

| | | | |
|---|---|---|---|
| 3,377,747 | 4/1968 | Donkin | 49/450 X |
| 3,959,926 | 6/1976 | Noecker et al. | 49/450 X |
| 4,167,835 | 9/1979 | Nobes et al. | 49/453 X |

FOREIGN PATENT DOCUMENTS

| | | | |
|---|---|---|---|
| 1434974 | 4/1970 | Fed. Rep. of Germany | 49/453 |
| 2066339 | 5/1983 | United Kingdom . | |

*Primary Examiner*—Kenneth Downey

*Attorney, Agent, or Firm*—Watson, Cole, Grindle & Watson

[57] ABSTRACT

A double glazing arrangement has at least one pane mounted between two opposed vertical channels and arranged for both vertical sliding movement within the confines of the channels without the provision of a counterbalancing system and movement in at least one lateral direction for removal of the pane without any initial dismantling of the arrangement. Releasable catches are provided which are for both holding the pane in a plurality of raised positions and preventing lateral movement of the pane. The arrangement is particularly advantageous for a pane of transparent acrylic material.

9 Claims, 10 Drawing Figures

DOUBLE GLAZING ARRANGEMENT

BACKGROUND OF THE INVENTION

1. Field of the Invention

This invention relates to a double glazing arrangement.

2. Description of the Prior Art

Sash windows incorporating counterbalance systems are well known.

It is also known to provide a double glazing arrangement without a counterbalance system in which two panes are mounted between two opposed, vertical double channels for sliding movement therein, and having releasable catches for holding the respective pane in a plurality of raised positions. However, before each pane can be removed, it is necessary to partially dismantle the arrangement.

SUMMARY OF THE INVENTION

According to the invention a double glazing arrangement includes at least one pane mounted between two opposed vertical channels and arranged for both vertical sliding movement within the confines of the channels without the provision of a counterbalance system and movement in at least one lateral direction for removal of the pane without any initial dismantling of the arrangement, and releasable catches for both holding the pane in a plurality of raised positions and preventing the lateral movement of the pane.

Preferably the pane is capable of movement in either lateral direction, the pane having one of the catches at or adjacent each corner, each catch protruding further into the respective channel than the pane for sliding engagement with a vertical guideway therein, and each catch being capable of being withdrawn to allow the pane to be removed. Each catch is preferably spring held relative to the associated guideway within the adjacent channel.

It is also preferred that the catch at or adjacent each bottom corner of the pane protrudes still further into the respective channel past the associated guideway, and each channel has a series of internal stops at different heights for releasable engagement by the free end of the adjacent bottom catch. Each bottom catch may be mounted for pivotal movement to release the end of the catch from the stop with which it is engaged.

The stops within each channel are preferably provided by transverse sleeves through which pass fixing screws for that channel. Alternatively the stops may be the fixing screws themselves.

The double glazing arrangement may have two panes, and releasable catches for each frame.

The or each pane may include a sheet of transparent acrylic material.

The channels preferably include the side lengths of an outer frame.

BRIEF DESCRIPTION OF THE DRAWINGS

Various other objects, features and attendant advantages of the present invention will be more fully appreciated as the same becomes better understood from the following detailed description when considered in connection with the accompanying drawings, in which like reference characters designate like or corresponding parts through the several views and wherein.

DESCRIPTION OF THE PREFERRED EMBODIMENTS

Figure 1:
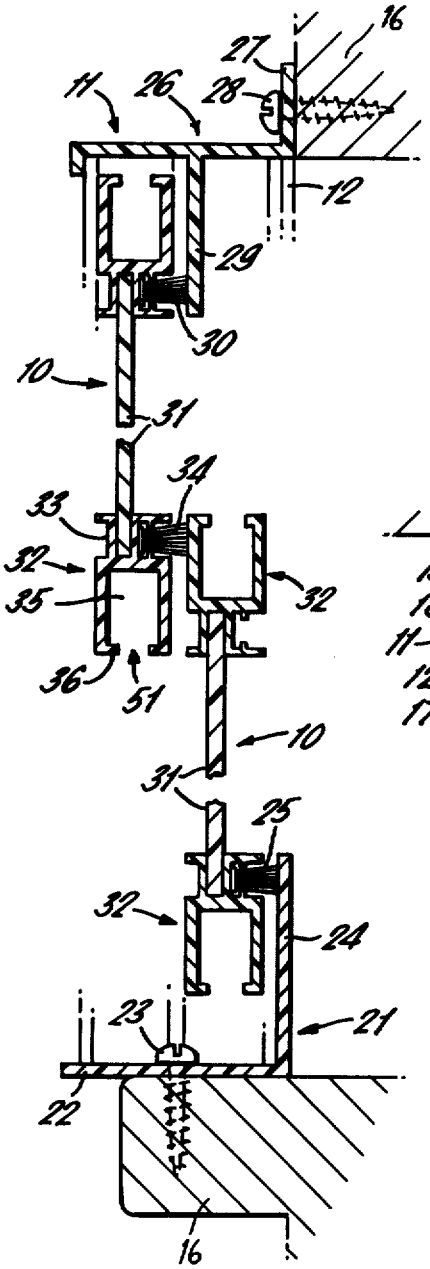
FIG. 1 is a diagrammatic vertical section through a double glazing arrangement, the catches for both panes being omitted.

Referring to FIGS. 1 to 10, a double glazing arrangement for two vertically sliding panes 10 has an outer frame 11 formed of four extruded lengths of unplasticised polyvinyl chloride or aluminium alloy. Each side length 12 (FIG. 2) has two channels 13 defining parallel slideways for vertical sliding movement of the panes 10. Access to the base of each channel 13 is restricted by longitudinal, spaced apart ribs 14 which provide an outwardly facing guideway within the channel and form an inner chamber 15 through which the side length 12 is attached to a window surround 16 by screws 17 at spaced intervals. Each screw 17 passes through a sleeve 18 within the inner chamber 15 of the respective channel and after fixing the side length in position the heads of the screws are concealed by individual screw head covers or a continuous cover strip. In this embodiment there is provided a continuous cover strip 19 which is a push fit into a longitudinal groove in the external face of the wall 20 of the side length remote from the window surround 16. The purpose of the sleeves 18 and guide ribs 14 is described below.

The bottom length 21 of the outer frame 11 is of L cross-section of which the base wall 22 provides for attaching the bottom length to the window sill by screws 23 and the back wall 24 provides a surface for engagement by a sealing brush 25 forming a part of the outer sliding pane 10.

The top length 26 of the outer frame primarily has a vertical flange 27 through which the top length is attached to the window surround 16 by screws 28, and a central, downwardly extending flange 29 which provides a surface for engagement by a sealing brush 30 forming a part of the inner sliding pane 10.

In this embodiment each sliding pane 10 includes a sheet 31 of transparent acrylic material surrounded by a frame again formed of four extruded lengths. The opposed top and bottom lengths 32 are of the same cross-section having an integral glazing gasket 33. In one wall of the glazing gasket 33 is a side facing groove capable of holding a sealing brush which is either one of the above mentioned brushes 25, 30 or a further brush 34. Each top and bottom length 32 also has an outwardly facing groove 35 which is partially closed by side ribs 36 defining a longitudinal slot 51.

The opposed side lengths 37 of the frame of each sliding pane again have the same cross-section as each other, each length including a glazing gasket having grooves on both sides for reception of sealing brushes 38.

Adjacent ends of the lengths 32, 37 are held in position by their functional engagement with the sheet 31, and are assembled so that the top and bottom lengths 32 overlap the side lengths 37. The outwardly facing grooves 35 of the top and bottom lengths are thus open at their ends.

Figure 2:
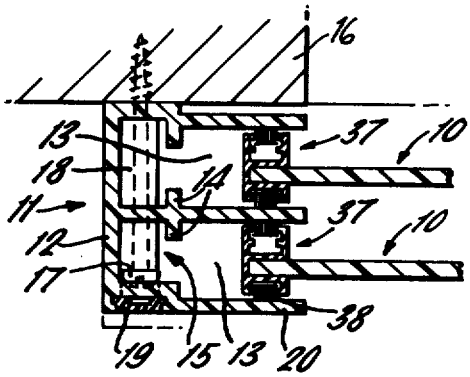
FIG. 2 is a diagrammatic horizontal section through part of the double glazing arrangement of FIG. 1, the catches again being omitted.
Figure 3:
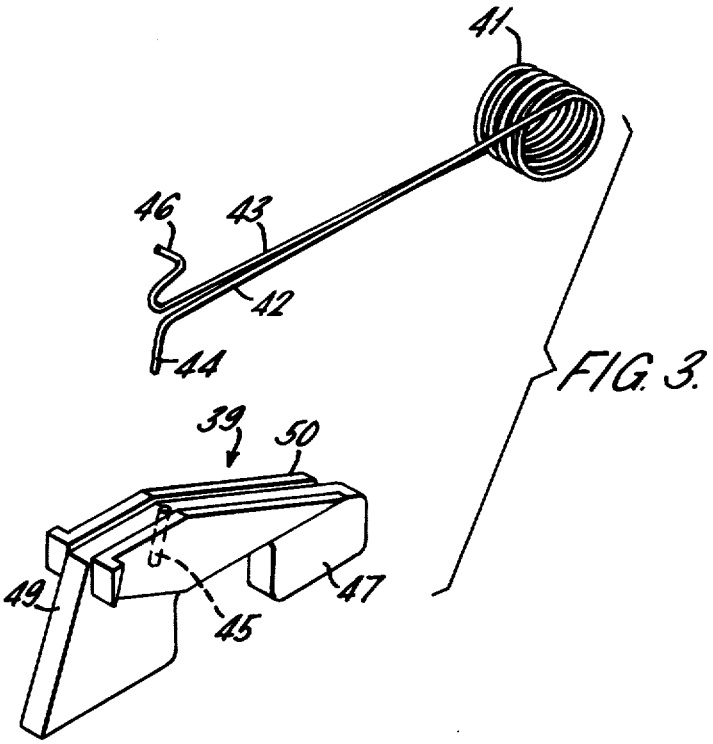
FIG. 3 is a perspective exploded view of one of the bottom catches of the double glazing arrangement of FIG. 1 for retaining the vertical sliding panes and for holding them in a raised position.
Figure 4:
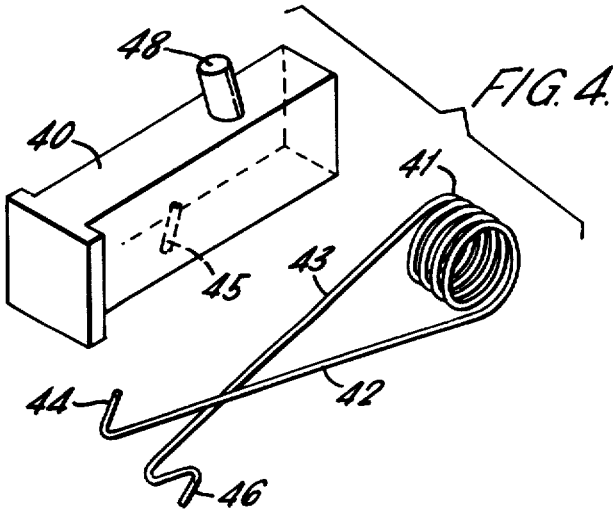
FIG. 4 is a similar exploded view to FIG. 3 of one of the top catches.

As shown in FIG. 2, the side lengths 37 of the frame of each pane 10 are spaced from the guide ribs 14 of the respective channels 13 within which the pane slides. Each pane is thus able to be moved laterally to remove the pane from the outer frame 11.

Figure 5:
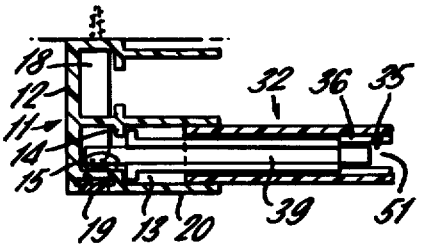
FIGS. 5 to 10 show three plan views and corresponding sections illustrating the operation of the bottom catches of FIG. 3.
Figure 6:
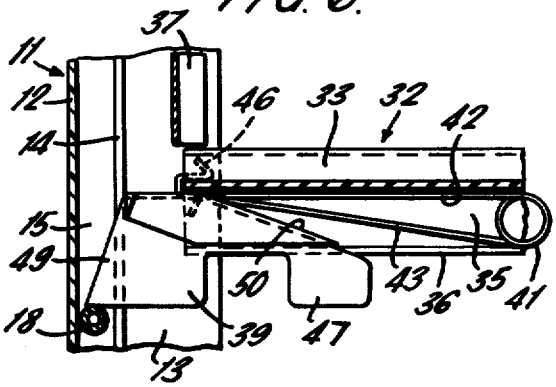

However, during normal operation, each pane 10 is prevented from such lateral movement by two bottom catches 39 (FIG. 3) and two top catches 40 (FIG. 4) which are positioned one at each open end of the top and bottom lengths 32 and are held by springs 41 within the grooves 35 so that they protrude outwardly therefrom in a sliding engagement with the associated vertical guideway provided by the ribs 14 of the adjacent channel 13 (FIGS. 5 and 6). For this purpose, each spring 41 has two arms 42, 43 extending longitudinally of the respective groove 35, one arm 42 having an end 44 bent to engage in a socket 45 in the respective catch 39,40 and the other arm 43 having a profile 46 capable of locking onto the end of the respective length 32, to one side of the glazing gasket 33.

Each bottom catch 39 has a trigger portion 47 protruding downwardly through the slot 51 of the bottom length 32 and each top catch 40 has an upstanding knob 48 protruding through the slot 51 of the upper length 32 whereby the respective catch may be withdrawn longitudinally into its groove 35, the associated spring 41 distorting sideways, if it is required to remove the pane.

Each of the two bottom catches 39 also has a relatively narrow pointed end 49 which in the extended position of the catch (FIGS. 5 and 6) protrudes into the inner chamber 15 of the respective channel 13 to rest on the sleeve 18 through which passes one of the fixing screws 17. Each bottom catch 39 also has a tapered portion 50 adjacent its trigger 47 which allows the catch to be pivoted (FIG. 8) to release the end 49 from the sleeve 18.

In operation, each pane 10 is held at a raised position by engagement of the bottom catches 39 with the sleeves 18 through which pass the side fixing screws 17 of the outer frame 11 (FIGS. 5 and 6).

Figure 7:
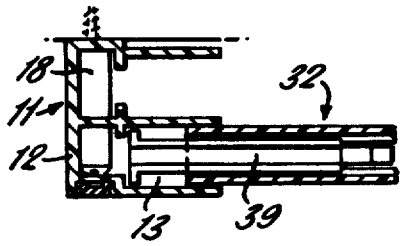
Figure 8:
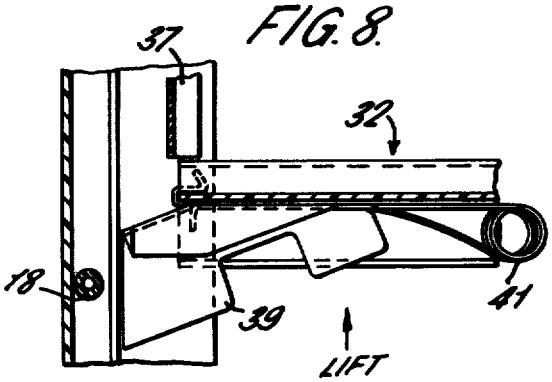
Figure 9:
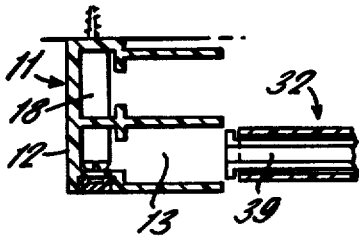
Figure 10:
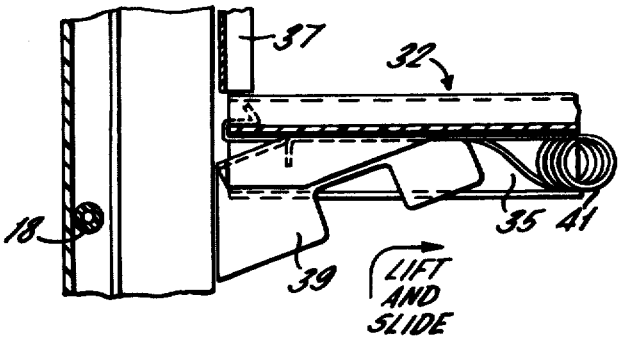

To raise or lower the pane 10 to a new height, the bottom catches 39 are pivoted out of engagement with the sleeves 18 (FIGS. 7 and 8).

For removal of the pane, the bottom catches 39 are pivoted out of engagement with the sleeves 18 and also all four catches 39, 40 are withdrawn inwardly of the grooves 35 (FIGS. 9 and 10), thereby allowing the pane to be moved laterally of the outer frame 11 and removed therefrom.

In the above described embodiment, each top catch 40 has the same form of spring 41 as each bottom catch 39. Alternatively the spring for each top catch 40 may be a simple coil spring extending longitudinally between the catch and a stop inwardly along the respective groove 35.

Figure 11:
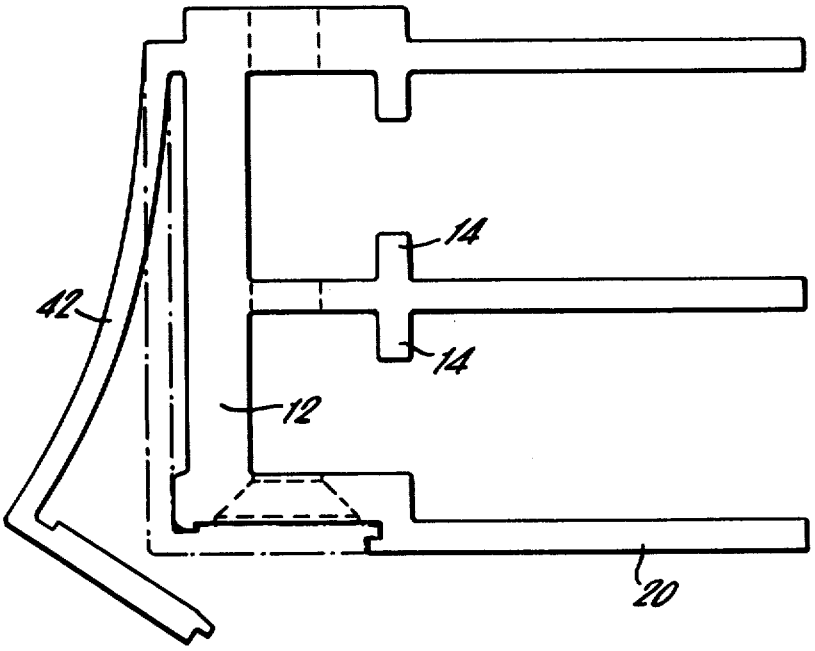
FIG. 11 is a plan view of a modified side length of the outer frame.

FIG. 11 shows a modified side length 12 of the outer frame 11 in which the cover strip 42 for the heads of the fixing screws forms a hinged, integral part of the extruded side length 12.

If desired, the sleeves 18 may be omitted. The fixing screws 17 then serve the stops engaged by the bottom catches 39.

Obviously, numerous modifications are variations of the present invention are possible in light of the above teachings. It is therefore to be understood that within the scope of the appended claims, the invention may be practiced otherwise than as specifically described herein.

I claim:

1. A double glazing apparatus comprising at least one sliding pane mounted for vertical movement between two opposed vertical channels each having a vertical guideway formed therein, the pane adapted for lateral movement towards and away from a base portion of each respective one of the channels for removal of the pane from between the channels, and a pair of catches on each side edge portion of the pane, each one of the catches protruding further into the respective channel than the pane for sliding engagement with the respective vertical guideway, each one of the catches adapted for withdrawal from said channel so as to allow the pane to be moved laterally and then removed, one catch of each of the pair of catches adapted for holding the pane in a plurality of raised positions by protruding still further into the respective channel past the associated guideway, and each channel having a series of internal stops provided therein at different heights for releasable engagement with a free end portion of the respective one catch of each of the pair of catches.

2. A double glazing apparatus as claimed in claim 1, wherein each catch comprises a spring held catch biased relative to the associated guideway within the adjacent channel.

3. A double glazing apparatus as claimed in claim 1, wherein each bottom catch is mounted for pivotal movement to release the end portion of the catch from the stop with which it is engaged.

4. A double glazing apparatus as claimed in claim 1, wherein the stops within each channel comprise transverse sleeves through which pass fixing screws for that channel.

5. A double glazing apparatus as claimed in claim 1, wherein said at least one pane comprises two panes, and further comprising releaseable catches for each pane.

6. A double glazing apparatus as claimed in claim 1, wherein the pane comprises a sheet of transparent acrylic material.

7. A double glazing apparatus as claimed in claim 1, wherein said channels comprise side members of an outer frame.

8. A double glazing apparatus as claimed in claim 1, wherein each one of the catches is provided at or adjacent one corner portion of the pane.

9. A double glazing apparatus as claimed in claim 1, wherein the one catch on each side of the pane for holding the pane is a plurality of vertical positions comprises a bottom catch on that side of the pane.

* * * * *